United States Patent [19]

Hagglund

[11] 4,172,374

[45] Oct. 30, 1979

[54] WIRE-COILING MACHINE

[75] Inventor: Erik Hagglund, New Canaan, Conn.

[73] Assignee: The Kanthal Corporation, Bethel, Conn.

[21] Appl. No.: 896,395

[22] Filed: Apr. 14, 1978

[51] Int. Cl.[2] ..... B21D 11/00

[52] U.S. Cl. ..... 72/66; 140/92.1; 242/7.13; 72/145

[58] Field of Search ..... 140/92.1; 72/66, 142, 72/138, 145; 242/7.13; 57/18

[56] References Cited

U.S. PATENT DOCUMENTS

| | | | |
|---|---|---|---|
| 283,557 | 8/1883 | Barney | 72/142 |
| 436,256 | 9/1890 | McPherson | 72/142 |
| 3,053,288 | 9/1962 | Burbank | 140/92.1 |
| 3,163,058 | 12/1964 | Hunter | 72/66 |
| 3,471,098 | 10/1969 | Jannett | 242/7.13 X |
| 3,672,026 | 6/1972 | Cutler | 140/92.1 |

*Primary Examiner*—Leon Gilden
*Attorney, Agent, or Firm*—Kenyon & Kenyon

[57] ABSTRACT

A wire-coiling machine has a non-rotating mandrel having a coil-starting portion which declines to a forwardly extending coiling portion. Means revolving about the coil-starting portion continuously feeds and winds under back-tension the wire to be coiled on this coil-starting portion, the latter having a declination and forward extent causing the wire while winding thereon to continuously slide radially downwardly and axially forwardly so as to feed and form coil convolutions on the mandrel's coiling portion while forcing the latter to continuously feed forwardly so as to continuously produce a coil in the form of a non-rotating coil. The mandrel can be very short with a free terminating end from which the non-rotating coil feeds continuously for easy collecting or processing operations.

3 Claims, 10 Drawing Figures

Fig. 1.
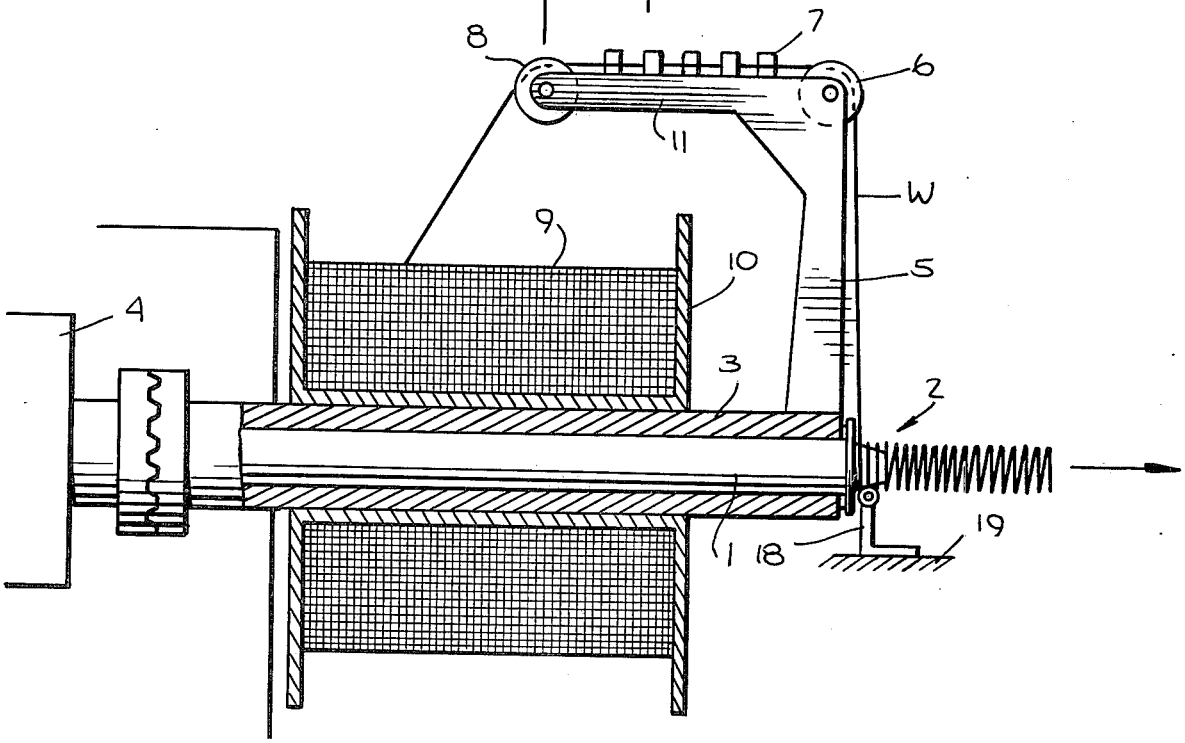
Fig. 6.
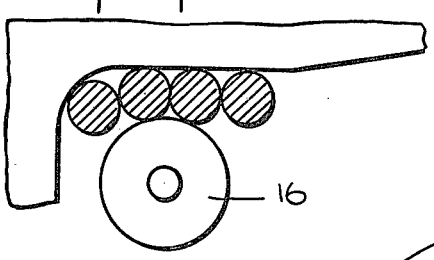
Fig. 7.
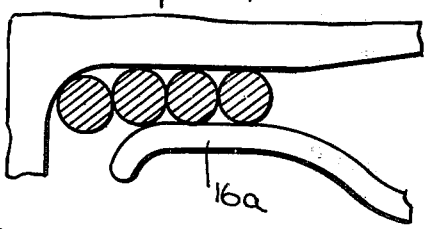
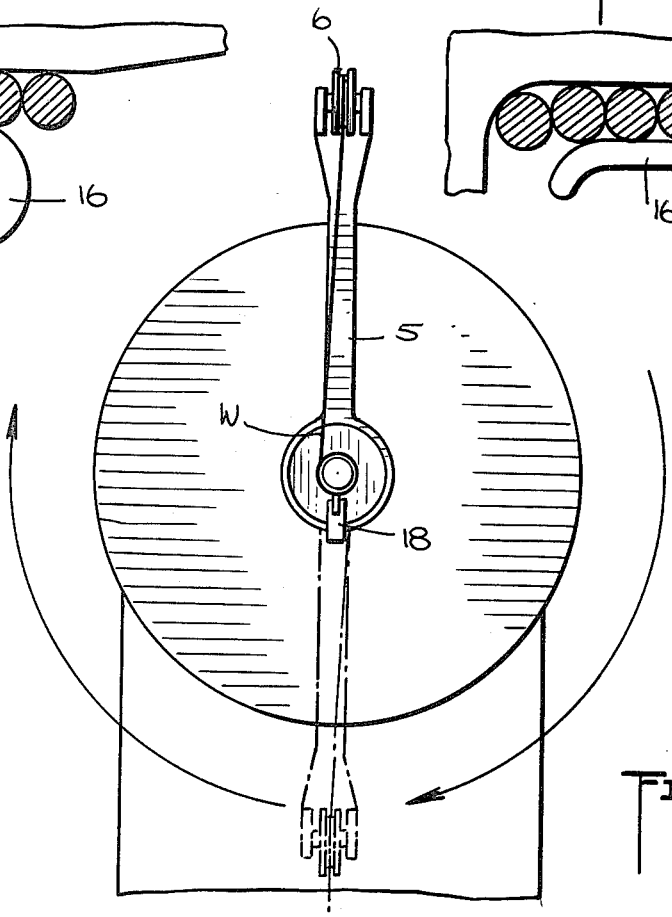
Fig. 2.

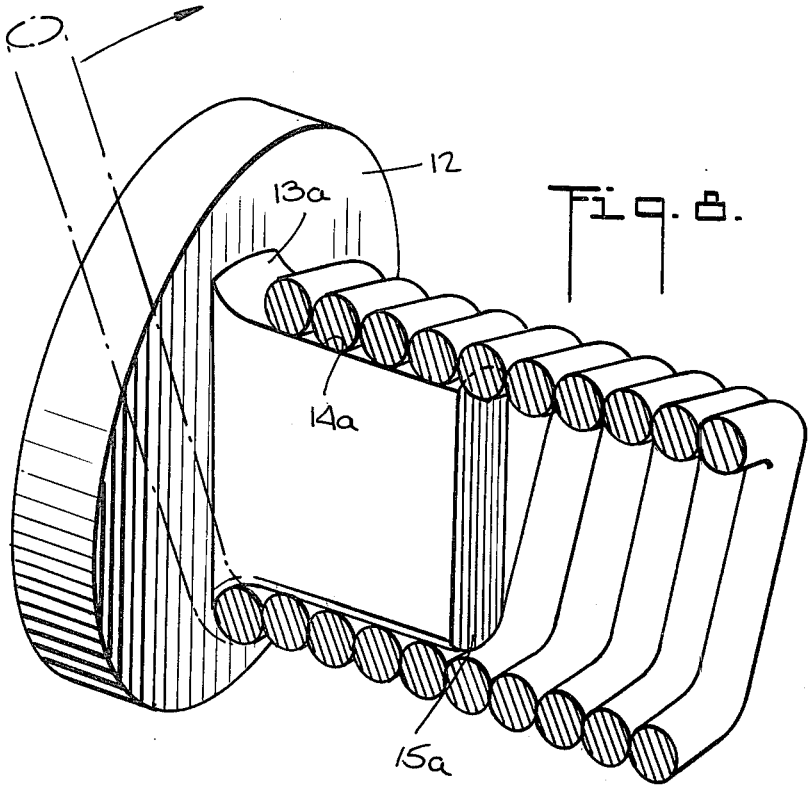
Fig. 8.
Fig. 9.
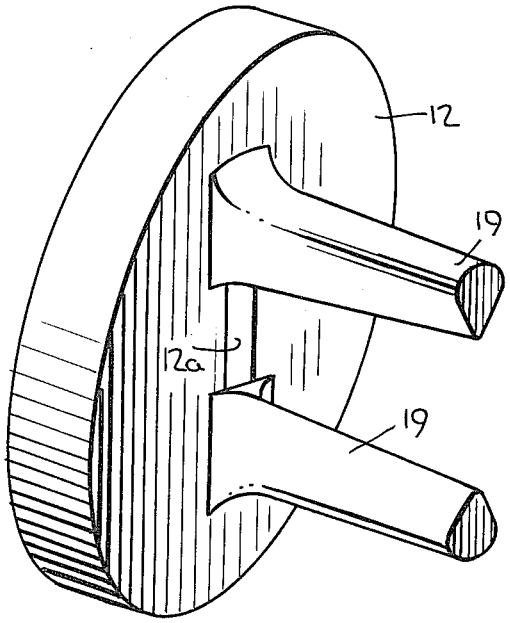
Fig. 10.
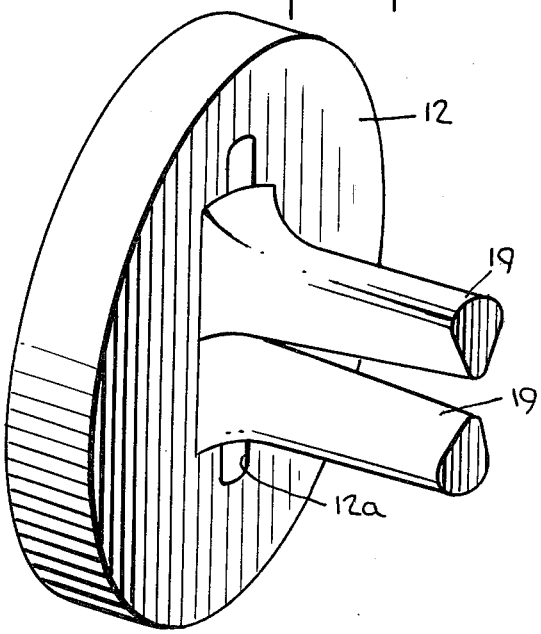

WIRE-COILING MACHINE

BACKGROUND OF THE INVENTION

Electric resistance wire and spring wire is frequently formed into permanently set coils formed by winding the wire on a mandrel having the cross-sectional shape and dimension of the desired coil configuration.

To produce a permanently set coil, the wire is usually wound on a mandrel under back-tension, the mandrel having a cross-sectional size related to the diameter of the wire and the wire's elastic limit so that as the wire bends on the mandrel its elastic limit is exceeded so that the wire becomes permanently deformed.

One way for doing this is to use a long rotating mandrel requiring both of its ends to be rotatively supported, the wire being fed to one end of this mandrel from a supply spool which is moved along the length of the mandrel so that the wire is progressively wound on the mandrel and a coil length is produced. Then one end of the mandrel must be freed so this coil can be removed from the mandrel. This practice is objectionable because it is a discontinuous operation and the coil length can be no longer than that of the mandrel.

For continuous coil production, the rotating mandrel can be made very short and have a free front end with its back end forming a conical flange, rotating with the mandrel, to which the wire is fed from a stationary supply spool, pressure rolls rotating about axes parallel to the mandrel pressing a few of the convolutions of the forming coil against the mandrel to obtain a friction drive overcoming the back-tension on the wire feed. The wire running against the conical flange wedges itself between this rotating flange and the wire just previously coiled so as to force the coil continuously from the free end of the mandrel, producing a continuous production of wire coil. A major objection to this practice is that the continuously produced coil is a rotating coil which after reaching a critical length begins to thrash about and become unmanageable, this requiring continuous cutting of the coil into lesser lengths possibly no greater than that obtainable from the long mandrel practice described above.

To overcome the above objection, the short mandrel can be non-rotating and the supply spool revolved about the mandrel so as to wind the wire on the mandrel starting at the mandrel's back end. However, in this case there is no rotating conical flange that can be used for coil feeding as described above and, therefore, complicated screw-type guides, cams rotating in synchronism with the revolving supply spool, and other mechanical parts have been required. An example of this practice is provided by the Moebus U.S. Pat. No. 3,503,236, May 31, 1970. Such mechanical complications are commercially objectionable.

SUMMARY OF THE INVENTION

The object of the present invention is to provide a wire-coiling machine using the short, non-rotating mandrel principle described above, without using complicated mechanisms for providing the necessary forward feed of the non-rotating coil produced.

This object has been achieved by providing a machine with a non-rotating and normally short mandrel with a coil-starting portion which declines preferably in the form of a smooth curve to a forwardly extending coiling portion having the transverse shape and dimension of the desired coil. This coil-starting portion is at the back end of the mandrel and preferably this coil-starting portion joins with a flange providing a surface extending radially from this portion's back end. All of these parts are non-rotating and may, if desired, be made as an integral unit.

The machine includes means revolving about that coil-starting portion for continuously feeding and winding on that portion, under back-tension, the wire to be coiled.

The coil-starting portion is made with a declination and forward extent causing the wire, while winding thereon, to continuously slide radially downwardly and axially forwardly on this portion so as to feed and form coil convolutions on the mandrel's coiling portion while, because of the forward movement, forcing the previously wound convolutions to move continuously forwardly over the mandrel's coiling portion so as to continuously produce a non-rotating coil.

The declining or downwardly curving coil-starting portion of the mandrel has an extent axially along the mandrel that is substantially the same as the diameter of the wire being coiled, particularly when curved, the wire being wound under back-tension, with preceding convolutions snubbing on the mandrel's coiling portion and providing a reaction to the wire back-tensioning, causing the wire winding thereon to slide, in effect, downwardly and forwardly providing a force pushing the coiled wire on the mandrel's coiling portion progressively ahead. The flange behind the coil-starting portion provides a radially extending surface at right angles to the axis of the mandrel and provides a back-up for a possible inaccurately aimed wire feed; in some instances there may be some wedging action exerted by the wire forcing itself between the front of this flange and the back end of the coil growing on the mandrel's coiling portion. However, the feeding action is mainly intended to be obtained by the short declining and preferably downwardly curved coil-starting part of the mandrel.

In the case of the short rotating mandrel described above, the conical flange at the back end of the mandrel revolves with the mandrel, making practical the forward feed by the wire wedging between the radially inner end of that conical surface and the back end of the coil. With the present invention the wire slides downwardly and forwardly on the declining coil-starting surface, making it possible for the back-up flange and the mandrel itself to be non-rotative or stationary.

In the foregoing way the present invention provides for the production of a non-rotating coil feeding forwardly solely by the action of the mandrel contour at its back end without requiring the wire to wedge itself between the two opposite surfaces of the flange and coil's back end and without using mechanical and possibly complicated feeding mechanisms. The mandrel of the present invention, of course, has a free end from which the non-rotating coil continuously feeds for easy gathering, welding of terminals in the case of electric resistance wire, and other operations which can be made only by having a non-rotating coil to work on.

When making a coil of circular cross section, the coil-starting portion is annular and the coiling portion is cylindrical or substantially cylindrical, although it may be slightly tapered to assure easy release of the coil from the mandrel. To assure the coil wire snubbing firmly on the mandrel's coiling portion, one or more small rollers can be used to press the convolutions against that portion, but in this case, the rollers can have axes at right angles to that of the coil so that the growing coil has a rolling contact with the rollers; in the case of the machine using the short rotating mandrel corresponding pressure rollers must have their axes parallel to the coil axes of necessity, the coil in its feeding direction then frictionally rubbing over the rollers which is not so desirable. However, friction pressure means may be used with the present invention.

When a coil with flat convolutions is produced, the non-rotating mandrel of the present invention is made correspondingly flat and in such an instance provides such a firm hold on the wire as to make it normally unnecessary to use any coil convolution pressing means. With a flat mandrel, the coil-starting portion is formed only at the back edge portions of the mandrel, the flat mandrel edges normally being curved. Instead of a flat integral mandrel, the flat shape may be formed by two arms or pins projecting forwardly, having integral coil starting and coiling portions but adjustably secured to the back flange so that flat coils of varying widths can be produced.

BRIEF DESCRIPTION OF THE DRAWINGS

The accompanying drawings somewhat schematically illustrate the foregoing features of this invention, the various figures being as follows:

FIG. 1 partly in longitudinal section and partly in elevation illustrates the necessary overall machine components;

FIG. 2 is a front end view of FIG. 1;

FIG. 6 is a detail showing the use of the pressure roller;

FIG. 7 is also a detail, but shows the use of a frictioned pressure element;

FIG. 8 is like FIG. 3 but shows the coiling of a coil having flat convolutions;

FIG. 9 shows the flat-type mandrel in an adjustable form; and

FIG. 10 is the same as FIG. 9 but shows a different adjustment as required to produce a coil having flat convolutions of less transverse extent than would be produced by the adjustment shown by FIG. 9.

DETAILED DESCRIPTION OF THE INVENTION

Figure 3:
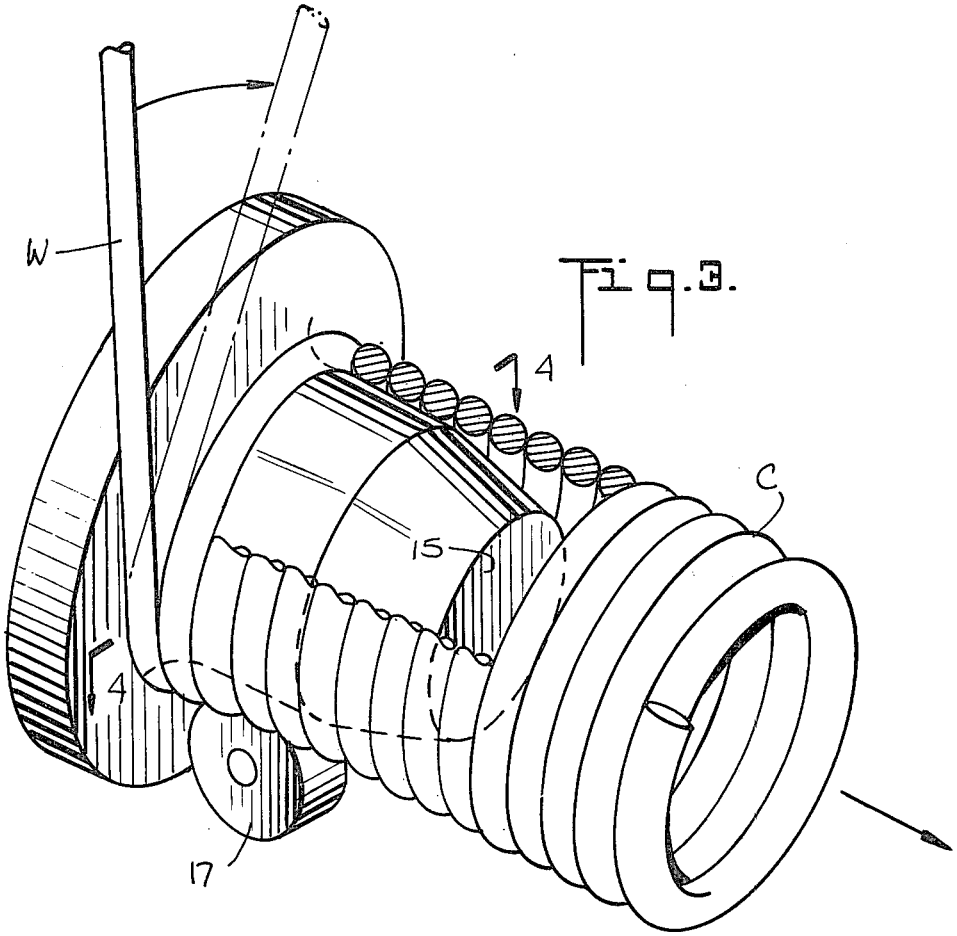
FIG. 3 is a perspective view showing the winding operation on the mandrel.

Referring first to FIG. 1, a non-rotating shaft 1 has a front end mounting the back end of the mandrel 2, a rotating tubular shaft 3 driven by a rotating power source 4 surrounding this shaft 1 and having a front end mounting a radial arm 5 having a revolving end on which a pulley 6 is mounted to guide the wire to be coiled W to the mandrel 2, the winding action pulling the wire W from the pulley 6 via wire back-tensioning means 7 over a pulley 8 from a wire supply 9 rotatively mounted by a supply spool 10 on the shaft 3. The wire-tensioning means 7 and the pulley 8 are mounted by a backwardly extending extension 11 of the arm 5. In this way a means is provided, revolving about mandrel 2, for feeding back-tensioned wire to the mandrel, this means revolving about the mandrel.

Figure 4:
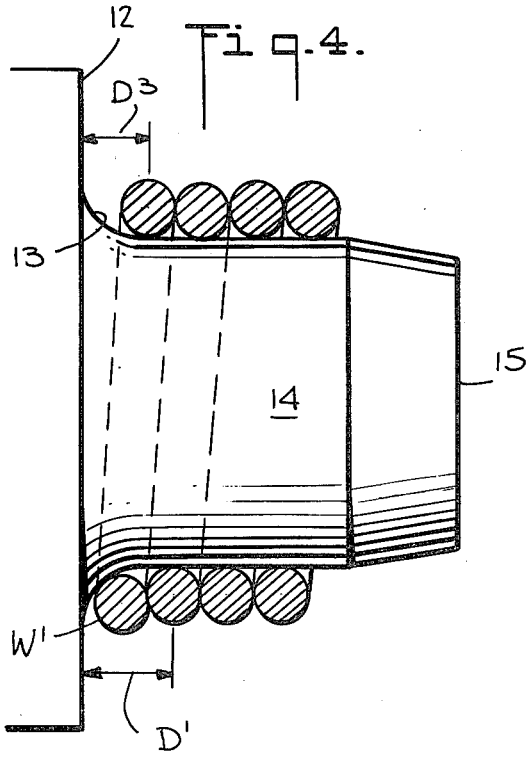
FIG. 4 is a cross section taken on the line IV—IV in FIG. 3.
Figure 5:
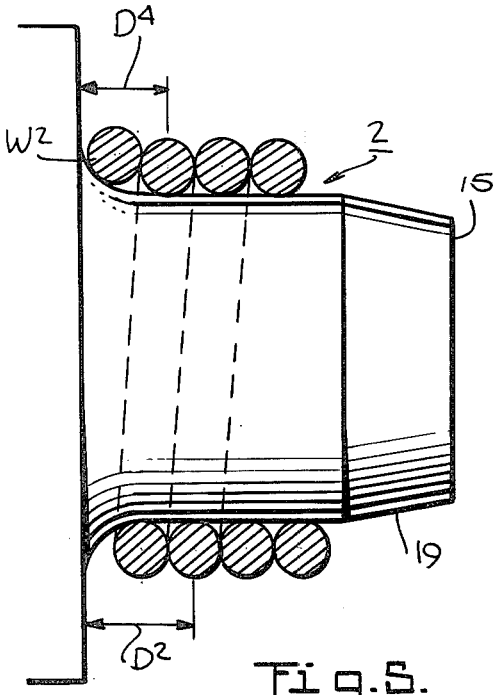
FIG. 5 is a corresponding cross section showing the progress of the winding and coil formation.

Going now to FIGS. 3 through 5, an integral mandrel construction is shown, having at its back end the radial surface 12, the coil starting portion 13 and the coiling portion 14, the mandrel terminating forwardly with the free end 15, all as previously described. The coil C in FIG. 3 is feeding from the free end 15 of the mandrel.

In FIGS. 4 and 5 the wire at $W_1$ is shown sliding downwardly and forwardly and pushing the back end of the coil forwardly, the displacement being indicated at $D_1$, this displacement continuing as indicated at $D_2$. Diametrically opposite in FIG. 4 the space $D_3$ is being formed which next increases to the space indicated at $D_4$ in FIG. 5 so that the wire at $W_2$ can start down the declining or curved coil-starting portion 13. This action progressively continues so that the non-rotating coil continuously feeds off of the front end 15 of the mandrel. The coiling portion 14 should be long enough for enough coiled convolutions to grip on it to a degree resisting the back-tensioning of the wire W, and this portion may be very slightly tapered and possibly terminate with a more sharp taper as indicated at 16.

As shown by FIGS. 3 through 5, a coil of circular contour is being produced, the portion 13 being, therefore, annular and the portion 14 cylindrical or substantially so. Preferably one or more pressure-applying rollers 17 may be positioned to press the convolutions against the portion 14 to increase their snubbing action on this portion, FIG. 1 illustrating that this roller may be mounted by a bracket 18 firmly mounted as indicated by the base member 19.

In FIGS. 8 through 10 the winding of a flat coil is illustrated. In FIG. 8 the necessary flat mandrel is shown as having curved edges which at their back ends form, as segments, the coil-starting surface 13*a*. The action is the same as described before, excepting that it is not considered necessary to use any pressure-applying means for increasing the coil snubbing on the mandrel.

FIGS. 9 and 10 show that the flat mandrel can be formed by two forwardly projecting arms or pins 19 with radially outer surfaces corresponding to those shown by FIG. 8 but with the two arms or pins mounted by the back-up flange 12 via a slot 12*a* so that the distance of separation between the two parts can be varied as indicated by comparing FIGS. 9 and 10. This permits the flat coiling of coils having flat convolutions of varying length transversely with respect to the coils.

I claim:

1. A wire coiling machine which continuously coils electric resistance and spring wire to continuously produce a permanently set single-layer non-rotating coil; said machine comprising a non-rotating longitudinally non-moving mandrel that is short in length as compared to its cross-sectional size and having a coiling portion having the transverse shape and dimensions of said coil and terminating with a free front end, said mandrel having a back end behind said coiling portion, means continuously revolving around said back end for continuously feeding said wire thereto with the wire under a back-tension, the cross-sectional size of said coiling portion and said back-tension being related to the diameter of said wire and its elastic limit so that bending of the wire under said back-tension around said coiling portion causes the wire's elastic limit to be exceeded so that the wire can form permanently set convolutions on said coiling portion, a non-rotating axially non-moving flange, said back end being connected to and extending forwardly from said flange in the form of a downwardly and forwardly curving coil-starting portion merging with said coiling portion and to which said wire initially feeds under said back-tension via said means, said coil-starting portion having an extent axially along said mandrel from said flange forwardly to said coiling portion that is substantially the same as said diameter of the wire so as to cause said wire fed thereon under said back-tension to slide radially downwardly and axially forwardly thereon against the back one of previously coiled convolutions while under said back-tension and thereby feed the wire to said coiling portion under said back-tension so that the wire bends around the coiling portion and continuously forms said convolutions thereon while continuously forcing the convolutions forwardly thereon and thereby continuously forming a coil traveling non-rotatively forwardly thereon and releasing therefrom over the mandrel's said free front end.

2. The machine of claim 1 in which said coil-starting portion is annular, said coiling portion is substantially cylindrical and means at least adjacent to said coil-starting portion are included for forming a surface pressing said coil convolutions against said coiling portion while permitting the convolutions to move forwardly thereon.

3. The machine of claim 1 in which said shape has a flat cross section.

* * * * *